US011892242B2

(12) United States Patent
Mao

(10) Patent No.: US 11,892,242 B2
(45) Date of Patent: Feb. 6, 2024

(54) MULTI-ANGLE ADJUSTABLE AND TRANSFORMABLE HEAT PIPE

(71) Applicant: ASIA VITAL COMPONENTS (CHINA) CO., LTD., Shenzhen (CN)

(72) Inventor: Chun-Lin Mao, Shenzhen (CN)

(73) Assignee: ASIA VITAL COMPONENTS (CHINA) CO., LTD., Shenzhen (CN)

( * ) Notice: Subject to any disclaimer, the term of this patent is extended or adjusted under 35 U.S.C. 154(b) by 69 days.

(21) Appl. No.: 17/561,732

(22) Filed: Dec. 24, 2021

(65) Prior Publication Data

US 2023/0204302 A1 Jun. 29, 2023

(51) Int. Cl.
*F28D 15/04* (2006.01)

(52) U.S. Cl.
CPC ..... *F28D 15/046* (2013.01)

(58) Field of Classification Search
CPC . F28D 15/046; F28D 15/0241; H05K 7/2029; H01L 23/427
See application file for complete search history.

(56) References Cited

U.S. PATENT DOCUMENTS 3,604,504 A * 9/1971 Kessler, Jr. ..... F28D 15/046 165/46
3,754,594 A * 8/1973 Ferrell ..... F28D 15/046 165/272
4,040,478 A * 8/1977 Pogson ..... F28D 15/0275 165/96
4,099,556 A * 7/1978 Roberts, Jr. ..... F28F 13/14 165/45
7,137,442 B2 * 11/2006 Kawahara ..... F28D 15/0233 165/104.21
2006/0162906 A1 * 7/2006 Hong ..... F28D 15/046 165/146

(Continued)

FOREIGN PATENT DOCUMENTS

CN 113207268 A 8/2021
TW 201928274 A 7/2019

(Continued)

OTHER PUBLICATIONS

Search Report dated Jun. 13, 2022 issued by Taiwan Intellectual Property Office for counterpart application No. 110144434.

*Primary Examiner* — Tho V Duong
(74) *Attorney, Agent, or Firm* — Bradley J. Thorson; DeWitt LLP

(57) ABSTRACT

A multi-angle adjustable and transformable heat pipe includes a sealed case body. A working fluid is filled in the sealed case body. At least one capillary structure is disposed on an inner wall of the sealed case body. The sealed case body has a front section, a rear section and a transformable flexible middle section. The middle section is positioned between the front section and the rear section in connection therewith. The middle section is composed of multiple support sections and multiple knot sections. The support sections and the knot sections are alternately arranged. Two sides of each knot section are respectively connected with adjacent support sections, whereby the support sections can be adjusted by the same angle or different angles with the knot sections serving as fulcrums so that the heat pipe can be multi-angle adjusted and transformed and located.

6 Claims, 3 Drawing Sheets

(56) References Cited

U.S. PATENT DOCUMENTS

| | | | | |
|---|---|---|---|---|
| 2008/0264613 | A1 | 10/2008 | Chu | |
| 2017/0234625 | A1* | 8/2017 | Inagaki | F28D 15/0241 165/104.26 |
| 2018/0031329 | A1* | 2/2018 | Wang | G06F 1/203 |

FOREIGN PATENT DOCUMENTS

| | | | |
|---|---|---|---|
| TW | 202120881 | A | 6/2021 |
| TW | M626409 | U | 5/2022 |

* cited by examiner

MULTI-ANGLE ADJUSTABLE AND TRANSFORMABLE HEAT PIPE

BACKGROUND OF THE INVENTION

1. Field of the Invention

The present invention relates generally to a heat pipe, and more particularly to a multi-angle adjustable and transformable heat pipe.

2. Description of the Related Art

A conventional heat pipe is a hollow metal tubular body. A proper amount of working fluid is filled in the chamber of the tubular body and a capillary structure is disposed in the chamber of the tubular body. The heat pipe is a one-dimensional linear heat transfer component. That is, the working fluid in an evaporator section at one end of the tubular body will first absorb heat generated from a heat source corresponding to the evaporator section. Then the liquid working fluid is transformed into vapor working fluid. The vapor working fluid flows through an adiabatic section of the tubular body to a condenser section at the other end of the tubular body, where the vapor working fluid heat-exchanges with external air to dissipate the heat. Thereafter, the vapor working fluid in the condenser section is cooled and transformed into liquid working fluid. Then the liquid working fluid goes back to the evaporator section under the capillary attraction of the capillary structure in the tubular body. Accordingly, the vapor-liquid two-phase transformation cycle is continuously repeated to achieve the remote end heat transfer and heat dissipation effect.

The conventional heat pipe is generally used in combination with a heat dissipation unit (such as a latch-type radiating fin assembly or an aluminum extrusion radiating fin assembly or a heat sink) to form a thermal module. The thermal module is assembled and disposed in an electronic device (such as a computer, a server, a telecommunication chassis, a mobile phone or a handheld device) to dissipate the heat generated by multiple heat sources arranged on a motherboard.

However, the heat sources arranged on a motherboard of the electronic device have different sizes and heights. Also, the packaging structures of the heat sources have different heights (non-uniform heights). In addition, many electronic components are arranged around the heat sources so that the space layout problem will lead to the problem of non-uniform heights. As a result, height differences exist between the heat sources so that when the evaporator sections of all the heat pipes of the thermal module are in contact with the heat sources by lap joint or in connection with the heat sink, the evaporator sections are positioned at different heights. However, the tubular body of the heat pipe is made of a metal tubular material (sheet material) with the same thickness by means of drawing. Therefore, when it is necessary to adjust the height difference between the evaporator section and the condenser section in adaptation to the height differences between the heat sources, due to the properties of metal material and the conformity of the thickness of the tubular material (sheet material), in case the adiabatic section is flexed or bent to meet the height difference requirement, the bridging force between the evaporator section and the condenser section of the heat pipe will make the evaporator section and the condenser section pull each other. As a result, the adiabatic section (transmission section) will be inward compressed or outward drawn and deformed. This will lead to breakage of the capillary structure in the heat pipe and damage of the tubular wall of the heat pipe. This will cause deterioration of the heat transfer efficiency or even failure of the heat pipe.

In order to solve the above problem, an improved heat pipe has been developed. The improved heat pipe has a flexible section between the evaporator section and the condenser section. The flexible section of the heat pipe has a bellows structure or has thinner tubular wall than the evaporator section and the condenser section so that the flexible section can be flexed and bent. However, when flexing the bellows structure or the flexible section with thinner tubular wall, interference will take place to produce crimps. In addition, the flexible section can be only bent by one angle or in one direction. As a result, the bending angle of the flexible section can be adjusted only in accordance with one of the electronic components. Therefore, the angle change of the heat pipe is limited and the heat pipe cannot be flexed by different angles or in different directions in adaptation to the arrangement of multiple heat sources or mechanisms with height differences. Accordingly, the conventional heat pipe truly needs to be improved.

SUMMARY OF THE INVENTION

It is therefore a primary object of the present invention to provide a multi-angle adjustable and transformable heat pipe including a transformable flexible middle section. The middle section is composed of multiple support sections and multiple knot sections. The support sections and the knot sections are alternately arranged. The support sections can be adjusted by the same angle or different angles with the knot sections serving as fulcrums so that the heat pipe can be multi-angle adjusted and transformed and located.

To achieve the above and other objects, the multi-angle adjustable and transformable heat pipe of the present invention includes a sealed case body. A working fluid i filled in the sealed case body. At least one capillary structure is disposed on an inner wall of the sealed case body. The sealed case body has a front section, a rear section and a transformable flexible middle section. The middle section is positioned between the front section and the rear section in connection therewith. The middle section is composed of multiple support sections and multiple knot sections. The support sections and the knot sections are alternately arranged. Two sides of each knot section are respectively connected with adjacent support sections, whereby the support sections can be adjusted by the same angle or different angles with the knot sections serving as fulcrums so that the heat pipe can be multi-angle adjusted and transformed and located.

In the above multi-angle adjustable and transformable heat pipe, a length of each support section along the lengthwise direction of the sealed case body is larger than or equal to a length of each knot section along the lengthwise direction of the sealed case body.

In the above multi-angle adjustable and transformable heat pipe, the sealed case body has an evaporator section, an adiabatic section and a condenser section. The evaporator section and the condenser section are respectively positioned in the front section and the rear section of the sealed case body, while the adiabatic section being positioned in the middle section.

In the above multi-angle adjustable and transformable heat pipe, the capillary structure has multiple first capillary structures and a second capillary structure. The first capillary structures are respectively disposed on inner walls of the evaporator section and the condenser section. The second capillary structure is disposed on inner walls of the support sections and the knot sections of the adiabatic section. The first capillary structures and the second capillary structure are in horizontal connection (mating) with each other. Alternatively, the first capillary structures and the second capillary structure are overlapped with each other as upper layer and lower layer. The first capillary structures and the second capillary structure are selected from a group consisting of sintered body, channels, mesh body, fiber, braid body and any combination thereof.

In the above multi-angle adjustable and transformable heat pipe, the sealed case body is a flat-plate heat pipe.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
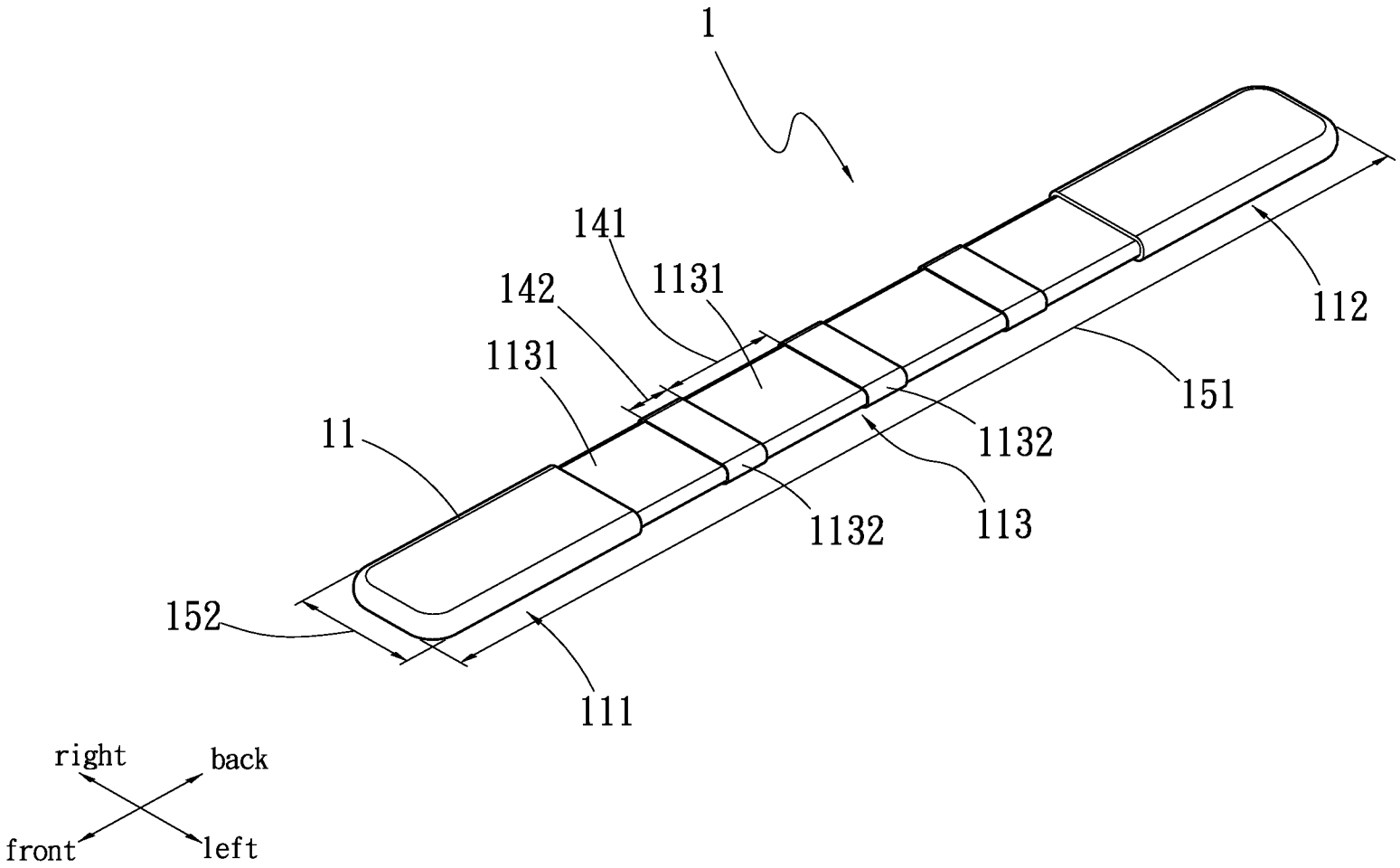
FIG. 1 is a perspective view of the multi-angle adjustable and transformable heat pipe of the present invention.
Figure 2:
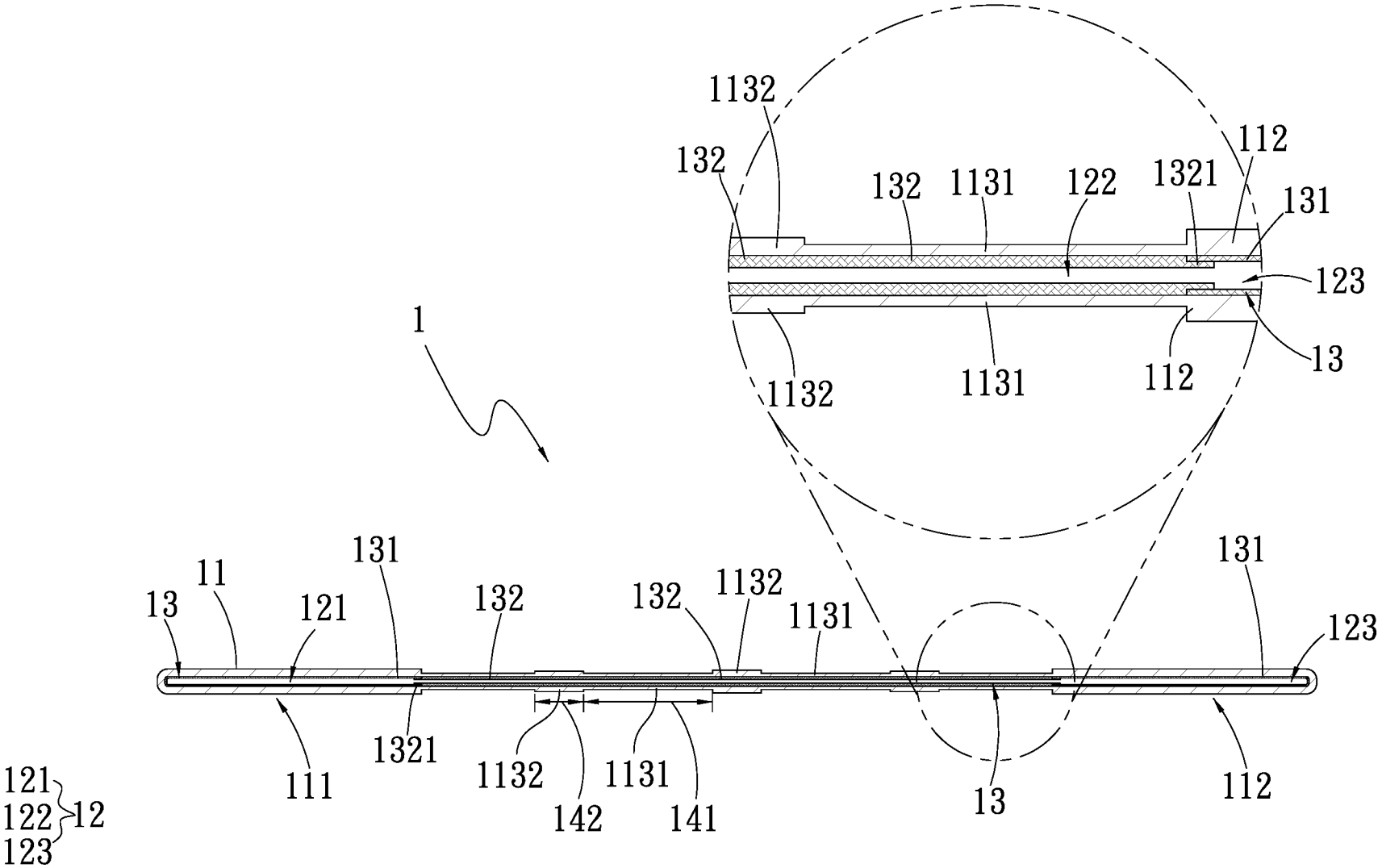
FIG. 2 is a sectional view of the multi-angle adjustable and transformable heat pipe of the present invention.
Figure 3:
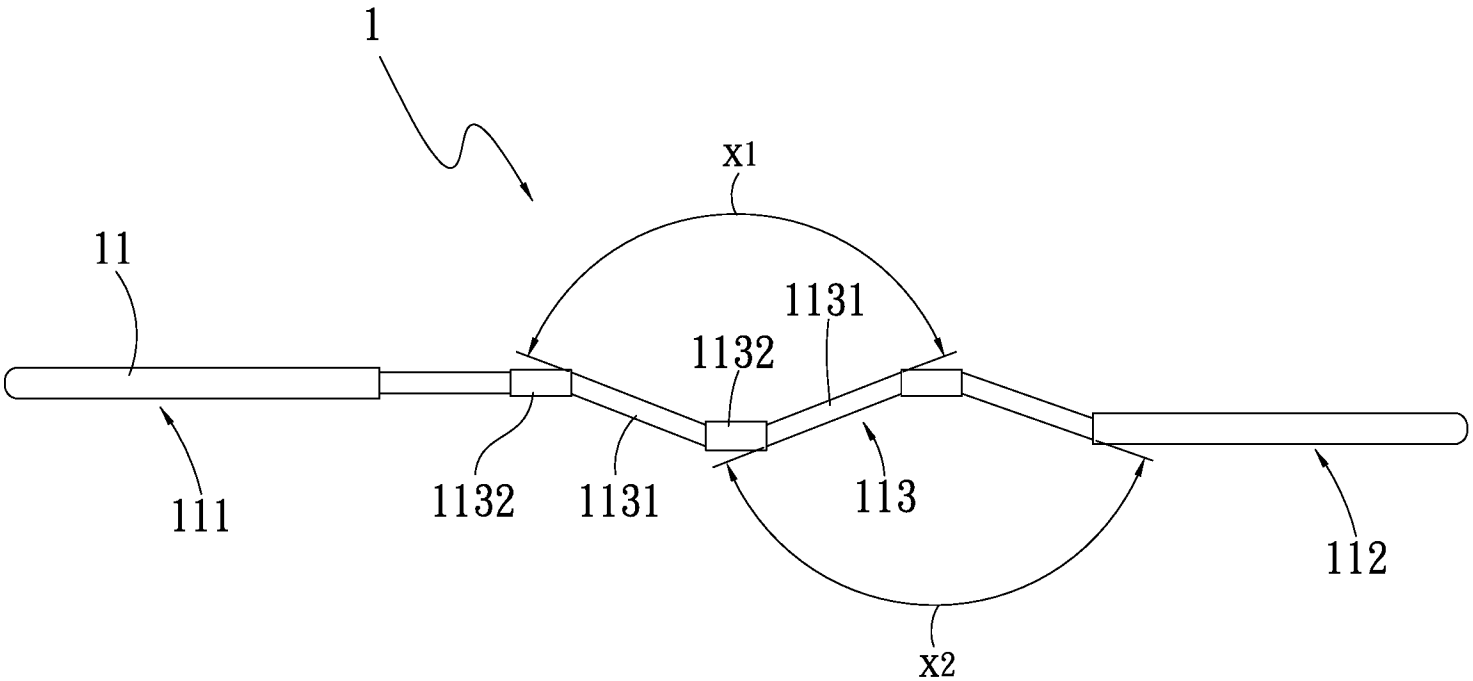
FIG. 3 is a side view of the multi-angle adjustable and transformable heat pipe of the present invention, showing that the heat pipe of the present invention is transformed, adjusted and located by many angles.

Please refer to FIGS. 1, 2 and 3. The multi-angle adjustable and transformable heat pipe 1 of the present invention includes a sealed case body 11. The sealed case body 11 can have a circular configuration, a D-shaped configuration or a flat-plate configuration. In this embodiment, the sealed case body 11 is in the form of a flat-plate heat pipe for illustration purposes. The sealed case body 11 has a chamber 12. A working fluid (such as pure water) is filled in the chamber 12. At least one capillary structure 13 is disposed on an inner wall of the chamber 12. The capillary structure 13 is selected from a group consisting of sintered body, channels, mesh body, fiber, braid body and any combination thereof. The sealed case body 11 has a front section 111, a transformable flexible middle section 113 and a rear section 112. The middle section 113 is positioned between the front section 111 and the rear section 112 in connection therewith. The middle section 113 is composed of multiple support sections 1131 and multiple knot sections 1132. The support sections 1131 and the knot sections 1132 are alternately arranged along a lengthwise direction of the middle section 113. In this embodiment, two sides of each knot section 1132 are respectively connected with adjacent support sections 1131, whereby the support sections 1131 and the knot sections 1132 together form a multi-knot structure.

The support sections 1131 can be adjusted by the same angle or different angles via the knot sections 1132. That is, the support section 1131 between each two knot sections 1132 is angularly adjusted with the knot sections 1132 serving as fulcrums. In addition, the junction between each knot section 1132 and the adjacent support section 1131 is a contact interference position. Accordingly, when the support section 1131 is angularly adjusted, the adjacent knot section 1132 will contact and interfere with the support section 1131 so as to restrict the move and adjustment of the support section 1131 within an angle range (such as one degree~89 degrees). Moreover, after the support section 1131 is adjusted by an angle, the knot section 1132 serves to locate the support section 1131 in the angular position. In addition, each two knot sections 1132 can provide an angular transformation or two different angular transformations. As shown in FIG. 3, one of each two adjacent knot sections 1132 and the two support sections 1131 in connection and adjacency to the knot section 1132 contain an angle X1, which is different from an angle X2 contained between the other knot section 1132 and the two support sections 1131 in connection and adjacency to the knot section 1132. Therefore, by means of the multiple knot sections 1132, many angular transformations can be provided so that the heat pipe 1 can be multi-angle adjusted and located and transformed into various configurations such as multiple U-shaped, N-shaped or otherwise shaped configurations. However, in practice, the angle X1 contained between one of each two adjacent knot sections 1132 and the two support sections 1131 in connection and adjacency to the knot section 1132 can be alternatively equal to the angle X2 contained between the other knot section 1132 and the two support sections 1131 in connection and adjacency to the knot section 1132. For example, the angle X1 and the angle X2 can be both zero degree. In this case, the middle section 113 is stretched into a horizontal state (as shown in FIG. 2). Each knot section 1132 also provides an effect to enhance the structural strength of the middle section 113.

Furthermore, in this embodiment, the length 141 of each support section 1131 along the lengthwise direction 151 of the sealed case body 11 is larger than the length 142 of each adjacent knot section 1132 along the lengthwise direction 151 of the sealed case body 11. Accordingly, the support section 1131 can be adjusted by larger angle. The lengthwise direction 151 of the sealed case body 11 means a direction from the front section 111 to the rear section 112. The widthwise direction 152 of the sealed case body 11 means a direction from a left side to a right side of the sealed case body 11. In a modified embodiment, the length 142 of each knot section 1132 along the lengthwise direction 151 of the sealed case body 11 is equal to the length 141 of the adjacent support section 1131 along the lengthwise direction 151 of the sealed case body 11. Alternatively, the length 142 of most knot sections 1132 along the lengthwise direction 151 of the sealed case body 11 is smaller than the length 141 of the adjacent support section 1131 along the lengthwise direction 151 of the sealed case body 11, while the length 142 of the rest knot sections 1132 along the lengthwise direction 151 of the sealed case body 11 is equal to the length 141 of the adjacent support section 1131 along the lengthwise direction 151 of the sealed case body 11. The longer knot sections 1132 and the shorter knot sections 1132 cooperate with each other, whereby the length of the knot sections 1132 of the middle section 113 can be adjusted and changed so as to change the angle adjustment range of the support sections 1131.

Furthermore, it should be noted that in this embodiment, the chamber 12 of the sealed case body has an evaporator section 121, an adiabatic section 122 and a condenser section 123. The evaporator section 121 and the condenser section 123 are respectively positioned in the front section 111 and the rear section 112 of the sealed case body 11, while the adiabatic section 122 is positioned in the middle section 113 between the evaporator section 121 and the condenser section 123. The capillary structure 13 has multiple first capillary structures 131 and a second capillary structure 132. The first capillary structures 131 and/or the second capillary structure 132 are selected from a group consisting of sintered body, channels, mesh body, fiber, braid body and any combination thereof. The first capillary structures 131 are respectively disposed on inner walls of the evaporator section 121 and the condenser section 123. In addition, the first capillary structures 131 of the evaporator section 121 and the condenser section 123 are selectively the same capillary structures or different capillary structures. The second capillary structure 132 is disposed on inner walls of the support sections 1131 and the knot sections 1132 of the adiabatic section 122. The first capillary structures 131 and the second capillary structure 132 are in horizontal connection (mating) with each other. Alternatively, the first capillary structures 131 and the second capillary structure 132 are overlapped with each other as upper layer and lower layer. In this embodiment, the first capillary structures 131 and the second capillary structure 132 are overlapped with each other. That is, each of two ends of the second capillary structure 132 has an extension section 1321. The extension sections 1321 respectively extend onto the first capillary structures 131 of the evaporator section 121 and the condenser section 123 and are overlapped with the first capillary structures 131 in contact therewith. Accordingly, when the support sections 1131 are angularly adjusted, the extension sections 1321 of the second capillary structure 132 will outward extend or inward retract on the first capillary structures 132. The thickness of the second capillary structure 132 of the support sections 1131 is larger than or equal to the thickness of the support sections 1131 so as to enhance the structural strength of the support sections 1131.

In a modified embodiment, the second capillary structure 132 is alternatively multiple second capillary structures 132 respectively disposed on inner walls of the support sections 1131 and the knot sections 1132. The second capillary structure 132 of the support sections 1131 and the knot sections 1132 are different capillary structures or complex capillary structures. The extension sections 1321 extending from two ends of the second capillary structures 132 of each support section 1131 extend onto the second capillary structures 132 of the adjacent knot sections 1132 and are overlapped with the second capillary structures 132 in contact therewith. In addition, the extension sections 1321 of the second capillary structures 132 of each support section 1131 in adjacency to the evaporator section 121 and the condenser section 123 extend onto the adjacent first capillary structures 131 and are overlapped with the first capillary structures 131 in contact therewith. Accordingly, when the support sections 1131 are angularly adjusted, the extension sections 1321 of the second capillary structure 132 of the support sections 1131 will outward extend or inward retract on the second capillary structures 132 of the knot sections 1132.

An outer side of the front section 111 of the sealed case body 11 is attached to and in contact with an electronic component (such as a central processing unit or a graphics processing unit, not shown) to absorb the heat generated by the electronic component. At this time, the working fluid in evaporator section 121 is heated and transformed into vapor working fluid. The vapor working fluid flows through the adiabatic section 112 to the condenser section 123 at a remote end to dissipate the heat outward. The vapor working fluid in the condenser section 123 is cooled and transformed into liquid working fluid. Then the liquid working fluid goes back to the evaporator section 121 under the capillary attraction of the first and second capillary structures 131, 132 of the capillary structure 13 on the inner wall of the chamber 12. Accordingly, the vapor-liquid two-phase transformation cycle is continuously repeated to achieve the remote end heat transfer and heat dissipation effect.

Please now refer to FIG. 3, which is a side view of the multi-angle adjustable and transformable heat pipe of the present invention, showing that the heat pipe of the present invention is transformed, adjusted and located by many angles. As shown in the drawing, when the front section 111 and the rear section 112 of the heat pipe 1 respectively contact different objects at different heights, the support sections 1131 of the middle section 113 are adjusted and arranged by different angles or the same angle with the adjacent knot sections 1132 serving as fulcrums. Moreover, after adjusted, all the support sections 1131 are restricted by the adjacent knot sections 1132 and located in the angular positions. Accordingly, the middle section 113 can be freely adjusted and transformed into various configurations in adaptation to the installation positions of the heat sources.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A multi-angle adjustable and transformable heat pipe comprising a sealed case body, a working fluid being filled in the sealed case body, at least one capillary structure disposed on an inner wall of the sealed case body, the sealed case body having a front section, a rear section and a transformable flexible middle section, the at least one capillary structure having multiple first capillary structures and a second capillary structure, the first capillary structures being respectively disposed on inner walls of the front section and the rear section, the second capillary structure disposed on inner walls of the middle section and having two ends respectively overlapped with the first capillary structures, the middle section being positioned between the front section and the rear section in connection therewith, the middle section being composed of multiple support sections and multiple knot sections, the support sections and the knot sections being alternately arranged, two sides of each knot section being respectively connected with adjacent support sections, whereby the support sections can be adjusted by the same angle or different angles with the knot sections serving as fulcrums so that the heat pipe can be multi-angle adjusted and transformed and located.

2. The multi-angle adjustable and transformable heat pipe as claimed in claim 1, wherein a length of each support section along the lengthwise direction of the sealed case body is larger than a length of each knot section along the lengthwise direction of the sealed case body.

3. The multi-angle adjustable and transformable heat pipe as claimed in claim 1, wherein the sealed case body has an evaporator section, an adiabatic section and a condenser section, the evaporator section and the condenser section being respectively positioned in the front section and the rear section of the sealed case body, while the adiabatic section being positioned in the middle section.

4. The multi-angle adjustable and transformable heat pipe as claimed in claim 3, wherein the first capillary structure being respectively disposed on inner walls of the evaporator section and the condenser section, the second capillary structure being disposed on inner walls of the support sections and the knot sections of the adiabatic section.

5. The multi-angle adjustable and transformable heat pipe as claimed in claim 4, wherein the first capillary structures and the second capillary structure are mesh bodies.

6. The multi-angle adjustable and transformable heat pipe as claimed in claim 1, wherein the sealed case body is a flat-plate heat pipe.

* * * * *